US009163899B2

(12) United States Patent
Evans

(10) Patent No.: US 9,163,899 B2
(45) Date of Patent: Oct. 20, 2015

(54) PAINTBALL FEEDGATE

(71) Applicant: HTR Development, LLC, Gotha, FL (US)

(72) Inventor: Ed Evans, Cambridge (CA)

(73) Assignee: HTR Development, LLC, Gotha, FL (US)

( * ) Notice: Subject to any disclaimer, the term of this patent is extended or adjusted under 35 U.S.C. 154(b) by 46 days.

(21) Appl. No.: 13/723,817

(22) Filed: Dec. 21, 2012

(65) Prior Publication Data

US 2014/0174422 A1 Jun. 26, 2014

(51) Int. Cl.
*F41B 11/00* (2013.01)
*F41B 11/52* (2013.01)

(52) U.S. Cl.
CPC ..... *F41B 11/52* (2013.01)

(58) Field of Classification Search
CPC ..... F41B 11/50; F41B 11/52; F41B 11/53
USPC ..... 124/45, 48, 51.1; 137/511, 843, 855
See application file for complete search history.

(56) References Cited

U.S. PATENT DOCUMENTS 3,664,759 A * 5/1972 Biheller ..... 415/147
3,807,444 A * 4/1974 Fortune ..... 137/512.1
3,861,416 A * 1/1975 Wichterle ..... 137/849
5,166,457 A 11/1992 Lorenzetti
5,809,983 A 9/1998 Stoneking
6,055,975 A 5/2000 Gallagher et al.
6,234,157 B1 5/2001 Parks
6,722,355 B1 4/2004 Andrews, Jr.
7,011,083 B2 3/2006 Ho et al.
7,077,118 B2 7/2006 Lewis
7,100,810 B1 9/2006 Bosch et al.
7,191,773 B2 3/2007 Vincent
7,216,641 B2 5/2007 Friesen et al.
D549,767 S 8/2007 Mitic
7,270,120 B2 9/2007 Broersma et al.
D562,134 S 2/2008 Studee
D564,047 S 3/2008 Choi
D567,303 S 4/2008 Neumaster
D572,318 S 7/2008 Broersma
7,431,026 B2 10/2008 Ho et al.
D597,152 S 7/2009 Kaakkola et al.
D599,615 S 9/2009 Wang
7,841,328 B2 11/2010 Italia et al.
8,118,016 B2 2/2012 Italia et al.
D679,341 S 4/2013 Riley
D682,364 S 5/2013 Riley

* cited by examiner

*Primary Examiner* — John Ricci
(74) *Attorney, Agent, or Firm* — Woodard, Emhardt, Moriarty, McNett & Henry LLP

(57) ABSTRACT

Among other things, there is shown embodiments of a feedgate for a paintball loader having vanes or paddles that permit supplying paintballs into the loader but limit or inhibit escape of paintballs from the loader through the supply hole. Embodiments can include a frame, which may be a single piece or multiple-piece structure, and an insert with flexible vanes or paddles. Embodiments can include a pivotable cap, and/or the insert can snap into the frame.

14 Claims, 11 Drawing Sheets

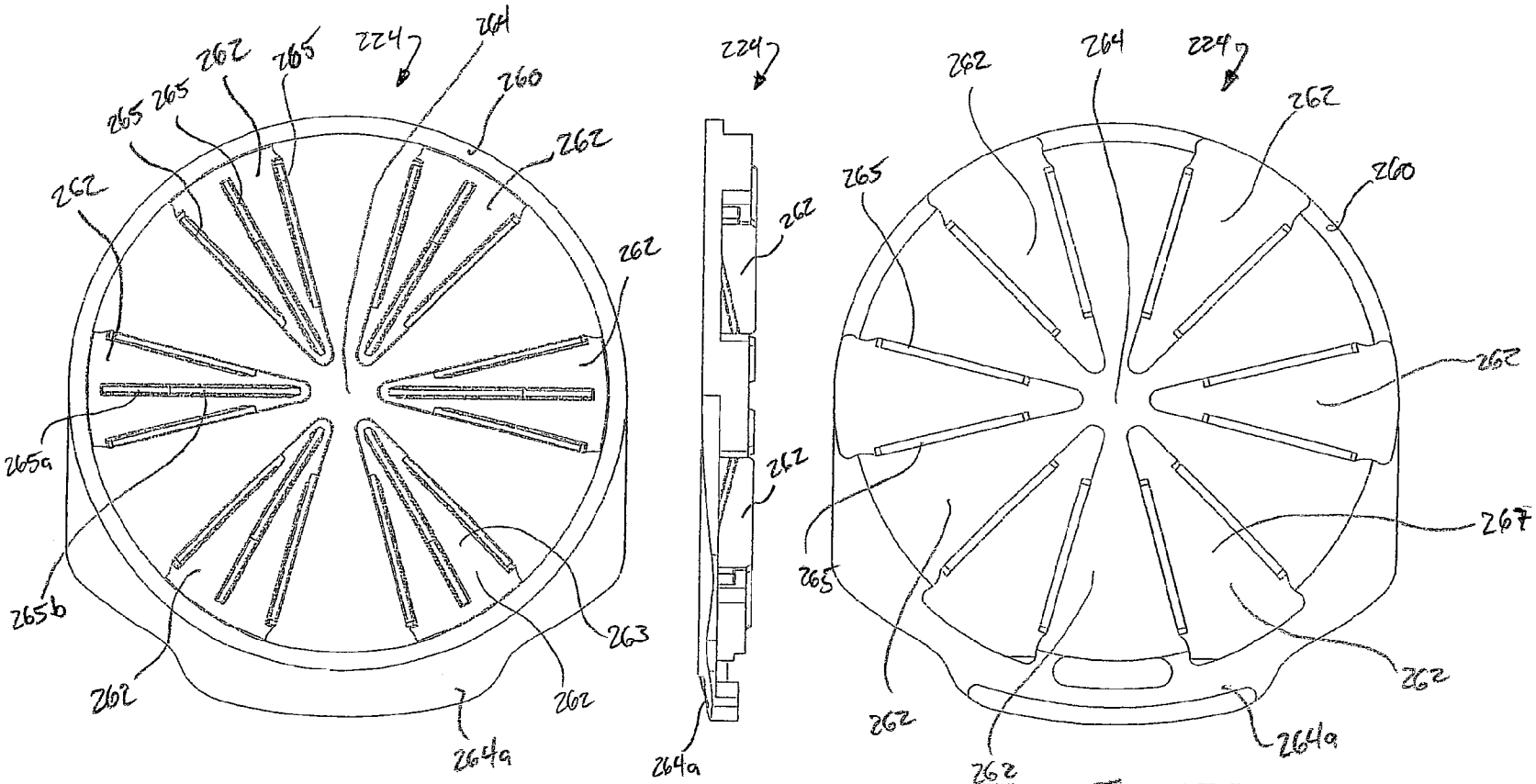
262
264a
265
222
224
262
263
264a
262
262
262

PAINTBALL FEEDGATE

The present disclosure concerns covering devices for the entrance opening to a paintball loader device. In particular, the disclosure concerns a feedgate for the loader opening that permits quick resupply of the loader and/or quick closure of the opening if needed.

BACKGROUND

In the sport of paintball, a gun or marker is used to fire balls or pellets with paint or other dye ("paintballs") in a competitive arena or environment. A common adjunct to the marker is a loader, which assembles to the marker and acts as a reservoir and feed mechanism to quickly and easily provide paintball ammunition for firing by the marker. Loaders are by their nature relatively large in volume compared to the marker, for storage of a reasonable quantity of paintballs, and current models generally sit atop the marker. The loader is supplied with paintballs via a large supply opening in the top of the loader.

Paintball events generally require participants to move and fire quickly, and in doing so jerky or random motions with the marker and loader can occur. With such movements, if the loader's supply opening is not covered, paintballs can be ejected or fall out of the loader through the supply opening. Loaders have been proposed with a firm cap for the supply opening, e.g. one that screws or snaps onto the loader to cover the opening. Such caps provide assurance that no paintballs will escape, but require extra time and force or effort to remove during an event, when a refill of the loader is necessary. Such extra time and effort is undesirable in fast-paced paintball competitions.

Devices known as feedgates have been proposed to provide a partial cover for the loader supply opening, so that a snap-on or screw cap is unnecessary. Such devices are better for paintball containment than having no cover at all for the supply opening, but include some drawbacks. Among these include the lack of a full-cover cap, which may be needed if a paintball competition occurs in rain or other inclement weather, the general permanence of the attachment of feedgate pieces to each other and to the loader, and difficulties in accurate placement of pods or other containers of paintballs relative to the feedgate for resupplying the loader. There remains a need for feedgates for paintball loaders that overcome such issues.

SUMMARY

Among other things, there are disclosed embodiments of feedgates for paintball loaders, which in some examples include a frame defining a central open area and an insert fixed with respect to the frame. The insert in particular examples has a base portion defining a middle open area with a center point and a plurality of vanes extending from the base portion into the middle open area, wherein at least one of the vanes includes a tip pointing in a direction offset from the center point of the middle open area. The plurality of vanes can be an even number of vanes, e.g. an equal number of first vanes and second vanes, with the first vanes being larger than the second vanes. Examples in which the first vanes have a wide portion attached to the base portion of the insert and narrow to a tip are shown, and the distance from the base portion of the insert to the tip may be approximately the distance from the base portion to the center point.

In particular embodiments, a first vane and second vane are adjacent each other, with the first vane is joined to the base via a first bridge portion that is offset with respect to the center of the first vane, and the second vane joined to the base via a second bridge portion that is offset with respect to the center of the second vane. The relative offsets of the first bridge portion with respect to the first vane and of the second bridge portion with respect to the second vane is one of toward each other or away from each other, to make bending or twisting easier on one side of a vane (or between two specific vanes) and more difficult on the other side of a vane (or between one of the specific vanes and its other adjacent vane). Some embodiments have at least one pair of vanes that include a flat shelf portion along one side and a raised ridge portion along the other side and adjacent the base portion of the insert. The at least one pair of vanes may be adjacent each other, e.g. with the respective vanes' flat shelf portions facing each other, and/or the respective vanes' sides having a raised ridge portion facing each other. Between the flat shelf portion and the raised ridge portion may be a curved wall. Where the pair of vanes have a raised ridge portion facing each other, as a particular example, a first of the pair of vanes may be joined to the base via a first bridge portion that is offset with respect to the center of the first vane, and a second of the pair of vanes may be joined to the base via a second bridge portion that is offset with respect to the center of the second vane. The relative offsets of the first bridge portion with respect to the first vane and of the second bridge portion with respect to the second vane is toward each other.

Embodiments in which the frame includes a base portion and a retaining ring that fits within the base portion of the frame are disclosed. The insert may be fixed to the frame with at least part of the base portion of the insert between the base portion of the frame and the retaining ring. The base portion of the frame can include an inner wall having a ledge, and the retaining ring can include an external wall with a tab, with the retaining ring fixed with the base portion of the frame when the tab is adjacent or engages the ledge. Other examples of a frame include a lower surface from which a tab extends for assembly with a paintball loader. Feedgate devices may also have a frame that includes an upper surface with a first front slot and a second rear slot, and a cap having a hinge boss inserted into the first front slot and a snap boss for insertion into the second rear slot. The cap is pivotable substantially around the hinge boss between an open position in which the cap does not impede access to the insert and a closed position in which the cap is over the insert.

Embodiments of feedgates for a paintball loader are also disclosed that include a frame defining a central open area, an insert fixed with respect to the frame and having a base portion defining a middle open area with a center point and a plurality of vanes extending from the base portion into the middle open area, such that the frame includes a space adjacent the central open area within which a part of the base portion fits, so that the insert is fixed within the frame. Such a space may include a side groove facing the central open area into which a part of the base portion of the insert fits, and/or a ledge adjacent the central open area which a part of the base portion of the insert engages, lies adjacent or faces. The insert can have a snap-fit with the frame. As indicated above, the frame can include a base portion and a retaining ring that fits within the base portion of the frame, e.g. with the space at least partially between the base portion of the frame and the retaining ring, so that the insert is fixed to the frame with at least part of the base portion of the insert between the base portion of the frame and the retaining ring. Another example has the base portion of the frame including an inner wall having a ledge, with the inner wall and ledge defining at least part of the space, and the retaining ring including an external wall with a tab. The retaining ring may be fixed with the base portion of the frame when the tab is adjacent or engages the ledge.

Further embodiments of a feedgate for a paintball loader can include a frame and an insert as indicated above, with the frame including a low-profile lip having a small upper slope and adapted to assist a user in locating and/or orienting a pod or other supply container for resupplying the loader. Particular examples of such feedgates, loaders and lips are discussed further below.

BRIEF DESCRIPTION OF THE DRAWINGS

FIG. 15A is a top plan view of a portion of the embodiment as shown in FIG. 11.

FIG. 15B is a side view of the portion shown in FIG. 15A.

FIG. 15C is a bottom plan view of the portion shown in FIG. 15A.

DESCRIPTION OF THE ILLUSTRATED EMBODIMENTS

Figure 1:
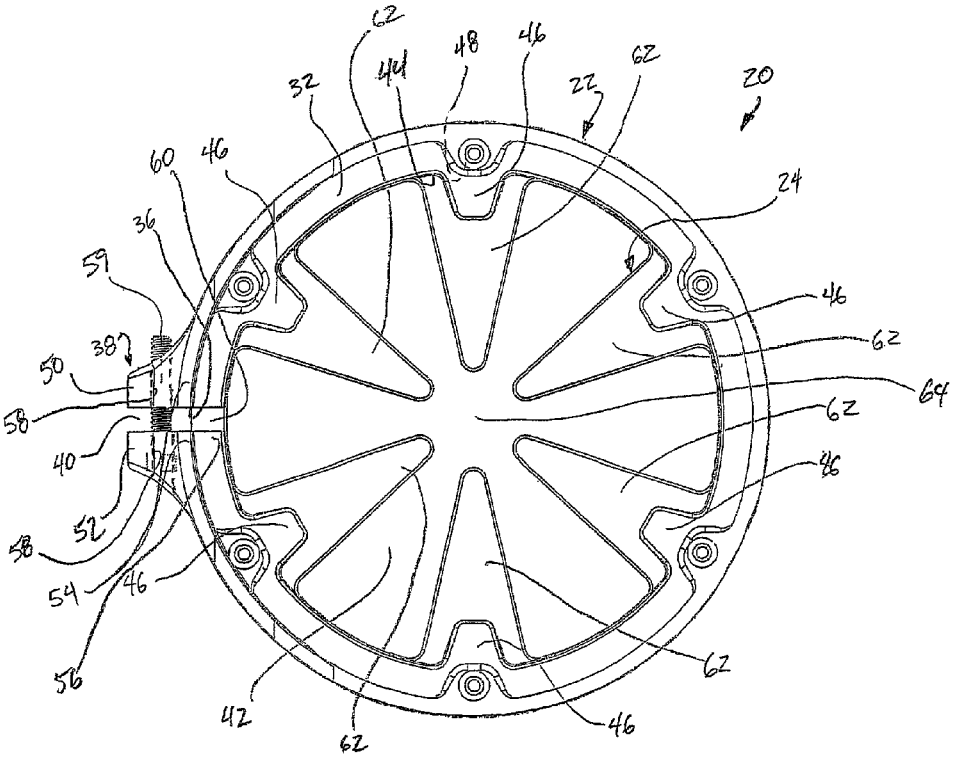
FIG. 1 is a top plan view of an embodiment of a feedgate for a paintball loader.
Figure 2:
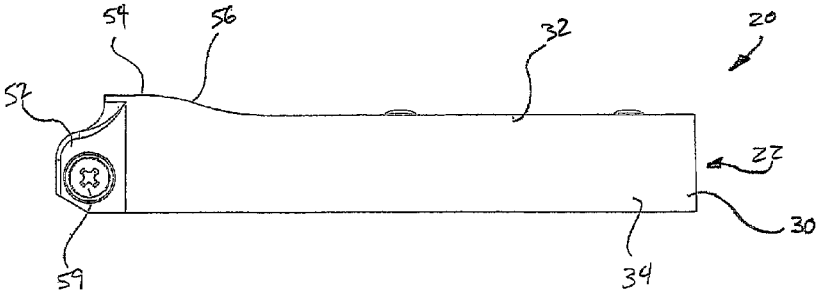
FIG. 2 is a side elevational view of the embodiment of FIG. 1.
Figure 3:
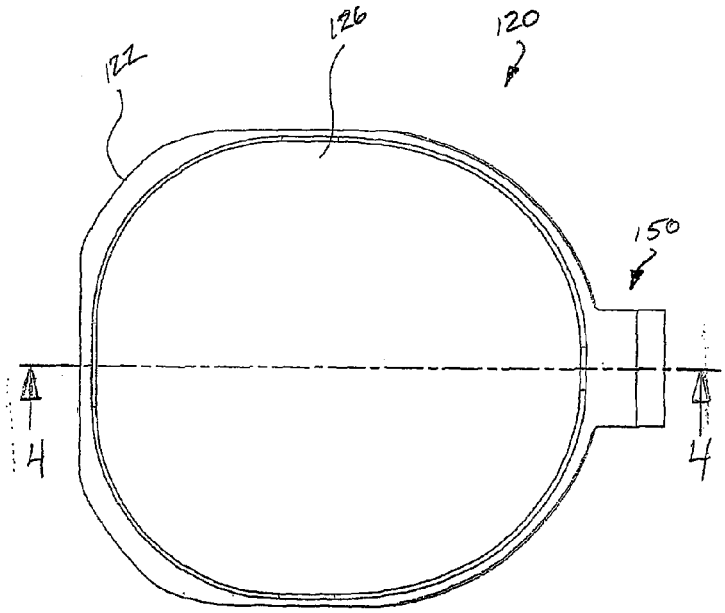
FIG. 3 is a top plan view of an embodiment of a feedgate for a paintball loader including a cap.
Figure 4:
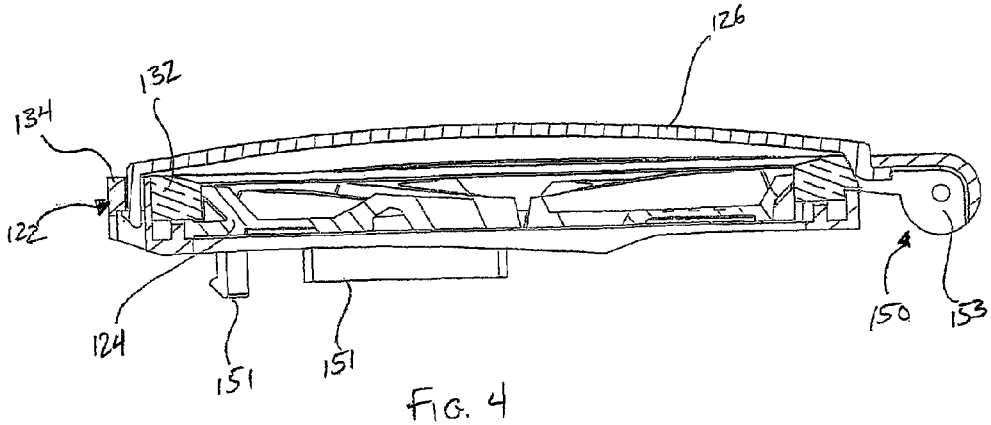
FIG. 4 is a cross-sectional view of the embodiment shown in FIG. 3, taken along the lines 4-4 in FIG. 3 and viewed in the direction of the arrows.

For the purposes of promoting an understanding of the principles of the disclosure, reference will now be made to the embodiments illustrated in the drawings and specific language will be used to describe the same. It will nevertheless be understood that no limitation of the scope of the claims is thereby intended, and alterations and modifications in the illustrated devices and methods, and further applications of the principles of the disclosure as illustrated therein are herein contemplated as would normally occur to one skilled in the art to which the disclosure relates.

Referring generally to the drawings, there is shown an embodiment of a feedgate 20 that includes a frame 22, an insert 24. Feedgate 20 is intended, as will be discussed further below, to fit over or around a flange or lip around the entry opening of a paintball loader. A supply of paintballs for the loader may be passed through feedgate 20 when installed on the loader, with feedgate 20 limiting or inhibiting the paintballs from exiting the loader through the supply opening.

Frame 22 in the illustrated embodiment features a rounded (e.g. generally circular) body 30 having an upper portion 32 and a lower portion 34 separated by a circumferential side groove 36. Frame 22 is broken or discontinuous at one side or area 38 by a gap 40, and substantially surrounds a central open area 42. Upper portion 32 has a generally circular edge 44 with a first set of flanges 46 that are inward-facing, i.e. generally directed toward open area 42, and in particular embodiments to a center point within open area 42. Each flange 46 includes a hole 48 in this embodiment for use in attaching frame 22 to insert 24, as will be discussed further below. In this example, all of flanges 46 face generally inward toward the center point within open area 42, and in particular embodiments are unitary or monolithic (e.g. molded with) frame 22. In particular embodiments flanges 46 abut or extend from or adjacent to groove 36.

Lower portion 34 extends from groove 36 in this embodiment to a lower surface or extremity of frame 22. In particular embodiments the lower surface or extremity of frame 22 is substantially planar. Lower portion 34 is adjacent to, facing, and/or against a portion of a paintball loader when in use, as will be discussed further below. For example, if an opening to a paintball loader has an extending lip or flange, lower portion can be placed over such a lip or flange so that the lip or flange is within a portion of central open area 42 beneath groove 36. In other embodiments, lower portion 34 may include an extending lip that can be fit into the entry opening into the paintball loader.

Gap 40 extends through both upper and lower portions 32 and 34 at a rear portion of device 20, giving frame 22 essentially a C-configuration. Gap 40 allows frame 22 to have some variability in overall size (e.g. circumference and area of central open are 42), so as to be useful with paintball loaders of different types. Across gap 40 from each other are two ears 50, 52 portions of which together form at least part of an upwardly-extending lip 54 for aiding the user in correctly locating and temporarily holding a pod or other container to or above device 20, during supply of paintballs from the pod or container through device 20 and into the paintball loader device. Many loaders have a sloped opening that made loading of paintballs difficult, and so a lip to locate and/or engage a pod during loading is provided. It has been found that a locating lip 54 that has a very low profile and a small upper slope 56 is more advantageous over examples that are taller, because it presents less of an obstacle to a user in moving a pod filled with paintballs over the feedgate, and less of an obstacle to the user's vision over the feedgate. The gentle slope as shown in the illustrated embodiment provides a backing or buttress if the user moves a pod of paintballs toward it, indicating that the pod is not quite correctly positioned, and also provides an easy-to-use guide if the user wishes to use the slope to position the pod, as by positioning the pod on the slope and moving the pod along the slope into the desired loading position. In particular, it has been found that a ratio between the diameter of the feedgate open area 42 and the height of lip 54 is about 22:1 (e.g. an opening diameter of about 65 mm and a lip height of about 3 mm) is advantageous. It is believed that such a ratio of between about 15:1 and about 25:1, and/or an overall height for lip 54 between about 2 mm and 5 mm, are effective in providing for easy placement and reducing the obstacle that lip 54 may present, both to loading and to viewing over the loader by the user. Slope 56 in the illustrated embodiment is slightly convex, with a maximum slope (decline:run) of about 1:2 or 1:3. In other embodiments, a linear (uniform) slope may be provided of about 1:4 or 1:5. Each of ears 50, 52 has a respective hole 58, which may be threaded, and a connecting screw, bolt or other link 59 extends through holes 58 to maintain a particular width of gap 40 and permit tightening of frame 22 around or within an entry hole for a paintball loader.

Insert 24 is a flexible, generally planar piece or paddle having an outer ring or base 60 and a number of inwardly-facing vanes 62. In the illustrated embodiment, base 60 is a continuous, circular portion forming an edge or border of insert 24 and having an open middle 64 with a center point. From an inside edge or surface of base 60, vanes 62 extend into the open middle 64. In particular embodiments, vanes 62 and base 60 are of the same material (e.g. flexible plastics, natural or synthetic rubber materials, or other firm elastic and flexible materials), and may be monolithic (i.e. part of one single piece). The illustrated embodiment shows six separate vanes 62 which are substantially identical, with each vane 62 having a wider portion joining to base 60 and narrowing linearly or uniformly toward a blunt or rounded tip. The tip of each vane 62 points generally to the center point within open middle 64 and is at a particular distance from the center, so that a circle can be drawn through each tip, and in exemplary embodiments that circle is at least slightly smaller than the diameter of standard paintballs. Further, the width of each vane 62 is preferably such that the size of the gaps between adjacent vanes 62 is smaller than the diameter of standard paintballs. It will be understood that in other embodiments, variations in the vanes 62 may be made. For example, a larger or smaller number of vanes may be used, bearing in mind the general desirability of keeping spaces between vanes smaller than the diameter of paintballs. Similarly, vanes may be made relatively wider or slimmer, or longer or shorter, than indicated in the drawings.

Insert 24 is fitted into frame 22 so that an outer portion of base 60 of insert 24 enters groove 36. In the illustrated embodiment, a portion of each vane 62 is adjacent or abutting a respective flange 46, with flange 46 above or atop the respective vane 62. In this way, the flexible vanes 62 are easily bent downward, i.e. generally toward lower portion 34 of frame 22, generally into or toward a loader to which device 20 is attached, and/or away from associated flanges 46. However, flanges 46 limit bending of their respective vanes 62 upward or outward, i.e. generally away from lower portion 34 of frame 22 and/or away from a loader to which device 20 is attached. The illustrated example uses rivets, screws or similar holders 66 to fix insert 24 within frame 22, with vanes 62 adjacent respective flanges 46. In other embodiments, insert 24 may be fixed to frame 22 in other ways, as with adhesives or by welding.

In use, device 20 is attached to a loader (not shown) by fitting device 20 over or into the supply hole of the loader, so that insert 24 and open area 42 of frame 22 are over the supply hole. Device 20 is then fixed to the loader in that position. For example, in embodiments of loaders having an upwardly-extending flange or collar, device 20 is placed so that part or all of the loader's collar is surrounded by lower portion 34 of frame 22, and frame 22 is tightened as by tightening screw or bolt 59 through ears 50, 52 to compress frame 22 around the loader's collar. In other embodiments, frame 22 may be attached to the loader in other ways, as by other mechanical methods or by adhesives.

With device 20 so positioned and fixed to the loader, the user can load paintballs easily through device 20 and into the loader. The user may take a pod or other container of paintballs and orient or locate the container (e.g. using slope 56 of lip 54) so that it is over open area 42 in frame 22 and vanes 62 of insert 24. Paintballs exiting the container hit vanes 62, which as noted above easily bend inward, and allow paintballs through and into the main chamber of the loader. When loading is complete, vanes 62 elastically return to or substantially to their initial position, so that gaps between vanes 62 are smaller than the diameter of the paintballs within the loader. As the user runs with, fires and otherwise engages in paintball activities with his or her marker and loader, the paintballs within the loader may be shaken or moved toward the loader's supply opening. Device 20 limits or inhibits exit of paintballs, as outward bending of vanes 62 when paintballs strike them from inside the loader is limited or inhibited by flanges 46.

It will be seen that device 20 does not include a covering or cap. In that form, the user can quickly resupply the loader with paintballs without taking time for a step of removing a cap. Embodiments discussed below can include a cap, and it will be understood that the above embodiment can also include a cap if desired.

Another embodiment of a feedgate device 120 similar in many respects to device 20 is shown in FIGS. 3-8. Features in device 120 that are identical or similar to features of device 20 are indicated by using the same number used above, with the prefix 1.

Feedgate device 120 includes a frame 122 and an insert 124. A cap 126 is provided that is attached to frame 122. Frame 122 is at least partially rounded in the illustrated embodiment, describing an ovoid or rounded square at least in part as shown in one example. Frame 122 includes an outer main or base portion 134 and an inner retaining ring 132 between which insert 124 is fixed. Base portion 134 is a generally continuous ring in the illustrated embodiment, having a forward extension 150 and lower tabs or flanges 151 for use in attaching device 120 to the loader. Extension 150 is rounded in a particular example and includes a central portion 153 (which may include an opening) from or through which an axle 156 can extend. In that example, extension 150 may be placed in or along a loader so that portion 153 aligns with a slot or opening in the loader, with axle 156 entering such a slot or opening. Flanges 151 may be fashioned as guides for guiding device 120 into a supply opening in the loader, or may include tabs at their respective ends, for snap-fitting or otherwise engaging a portion of the loader in or beyond its supply opening. In the example with tabs, frame 122 snaps into or firmly engages the loader via flanges 151, and when flanges 151 are disengaged or movable with respect to the loader, device 120 can be pivoted away from the loader supply opening around axle 156 in extension 150.

Base portion 134 further includes at least one internal lip, boss or groove 136 for engagement with retaining ring 132. In the illustrated embodiment, the inside wall of base 134 includes an upper portion 134*a* having a first internal diameter, and a lower, undercut portion 134*b* having a slightly larger second internal diameter. A ledge or support 134*c* extends inward (i.e. into or toward an open central area 142), which provides support for insert 124. In this embodiment, base portion 134 also includes two slots 155, 157 in its top surface to accommodate bosses or tabs on cap 126. Front slot 155 is adjacent extension 150 and accommodates a hinge boss. Rear slot 157 is diametrically opposed to slot 155 in this embodiment, and accommodates a snap boss.

Retaining ring 132 is generally circular in this embodiment, having at least enough flexibility to permit it to fit into (e.g. snap into) base 134, and enough rigidity to resist undesired disassembly from base 134. An outer edge or surface of ring 132 includes one or more bosses or snap tabs 137 for engagement with lip 136 of base portion 134, so that ring 132 is firmly held with base portion 134. In particular embodiments, a discrete number of tabs 137 are provided on ring 132, while in other embodiments a continuous ridge forming a single tab 137 can be formed around all or particular part(s) of the outer edge or surface of ring 132.

Insert 124 is a flexible, generally planar piece or paddle having an outer ring or base 160 and a number of inwardly-facing vanes 162. In the illustrated embodiment, base 160 is a continuous, flat or planar circular portion forming an edge or border of insert 124 and having an open middle 164 with a center point. From an inside edge or surface of base 160, vanes or paddles 162 rise from base 160 and extend into the open middle 164. In particular embodiments, vanes 162 and base 160 are of the same material (e.g. firm, flexible elastic materials as noted previously), and may be monolithic (i.e. part of one single piece).

Figure 5:
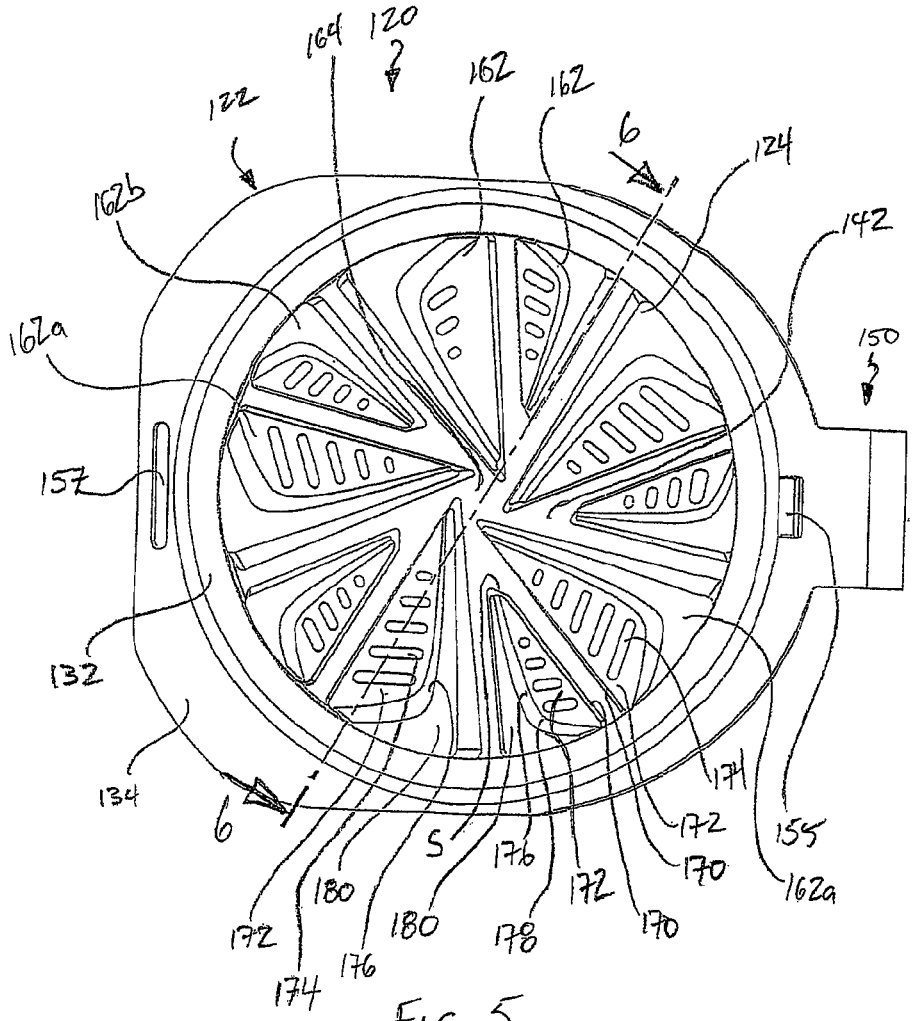
FIG. 5 is a top plan view of the embodiment of FIG. 3, omitting the cap.
Figure 6:
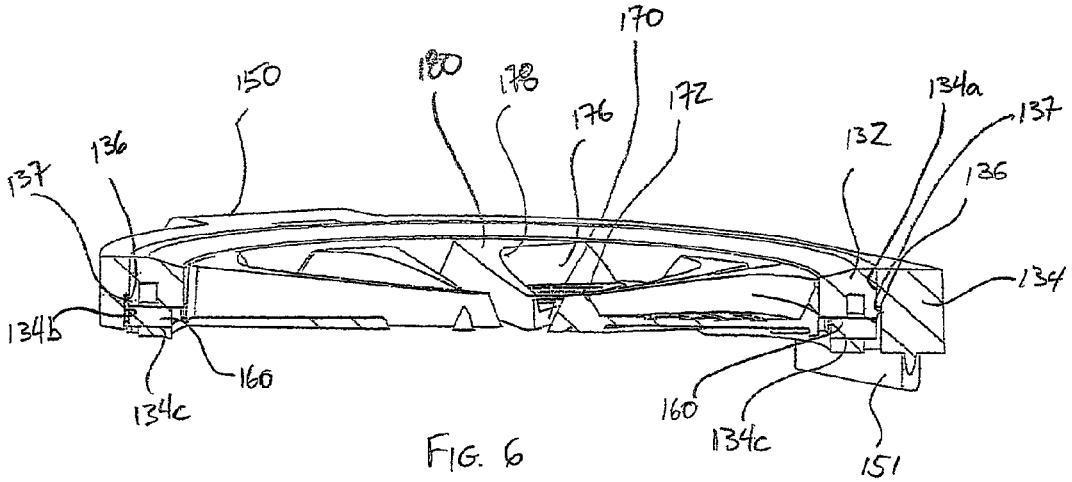
FIG. 6 is a cross-sectional view of the embodiment as shown in FIG. 5, taken along the lines 6-6 in FIG. 5 and viewed in the direction of the arrows.

The illustrated embodiment shows ten separate vanes 162, of which five are larger vanes 162*a* and five are smaller vanes 162*b*. Each vane 162 has a wider portion joining to base 160 and narrowing linearly or uniformly toward a tip. Each vane 162*a* extends from base 160 to its respective tip for a distance which is approximately the radius of the open middle 164, but the tip points away from the center point within open middle 164. In the illustrated example, the tip of each vane 162*a* is offset from the center point slightly to the left, as best seen in FIG. 5. Stated another way, a bisector of the angle formed at the tip of a vane 162*a* is non-radial, as are the sides of the vane 162*a*, pivoted slightly counterclockwise from radial as viewed in FIG. 5. Vanes 162*b* are similarly shaped and oriented, but are smaller than vanes 162*a*, with their base portions 160 extending along a smaller arc than the base portions 160 of vanes 162*a* and their tips extending a smaller distance into open middle 164 compared to the tips of vanes 162*a* (e.g. the tips of vanes 162*b* extend about ¾ of the distance into open middle 164 that the tips of vanes 162*a* do). In the illustrated embodiment, the tips or ends of vanes 162*b* have a substantially linear or planar cross-surface S that connects the respective sides of the vane.

Vanes 162, whether of the larger or smaller size, generally have the same configuration in the illustrated embodiment. One side 170 of a vane 162 forms a substantially flat shelf 172, that may include closed slots or ridges (indicated at 174) in some examples. Shelf 172 extends along the entire side 170 and toward the middle of vane 162, bounded by a middle wall 176 having an obtuse middle angle 178. The other side 180 of the vane 162 is a ridge or substantially convex formation that extends to (e.g. curves into) wall 176. Vane 162 may be thought of as a three-dimensional arrowhead shape having a portion removed to form shelf 172. In the illustrated embodiment, each adjacent pair of vanes 162*a*, 162*b* has like sides facing each other. That is, a shelf portion 172 of a vane 162*a*, 162*b* faces a shelf portion of an adjacent vane 162*b*, 162*a*, and a ridge or convex portion of a vane 162*a*, 162*b* faces a ridge or convex portion of an adjacent vane 162*b*, 162*a*. The facing shelf portions provide an easy path for paintballs to move through insert 124 and into the loader, while the thicker ridge or convex portions provide resistance to outward flexation of vanes 162. The variation of size in vanes 162 permit better coverage of open middle 164. It will be understood that in other embodiments, variations in the vanes 162 may be made. For example, a larger or smaller number of vanes may be used, bearing in mind the general desirability of keeping spaces between vanes smaller than the diameter of paintballs. Similarly, vanes may be made wider or slimmer, longer or shorter, or differently oriented with respect to the center than indicated in the drawings.

Figure 7A:
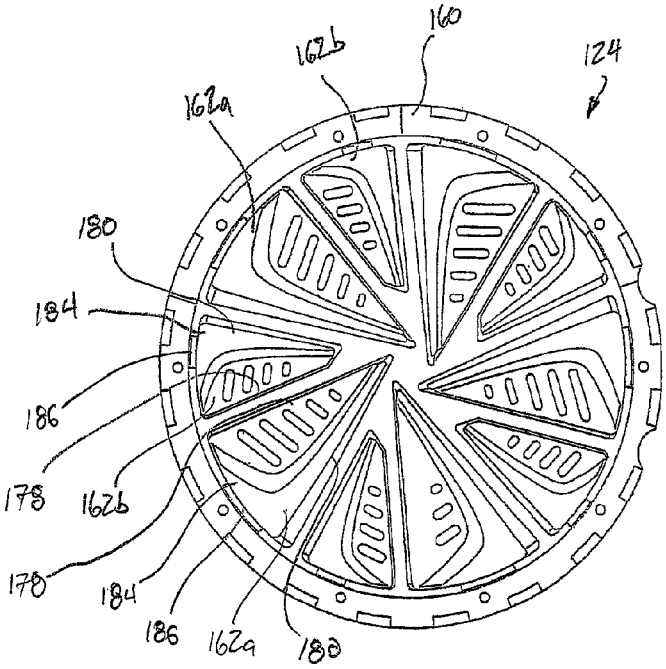
FIG. 7A is a top plan view of an embodiment of an insert member shown in FIG. 5.
Figure 7B:
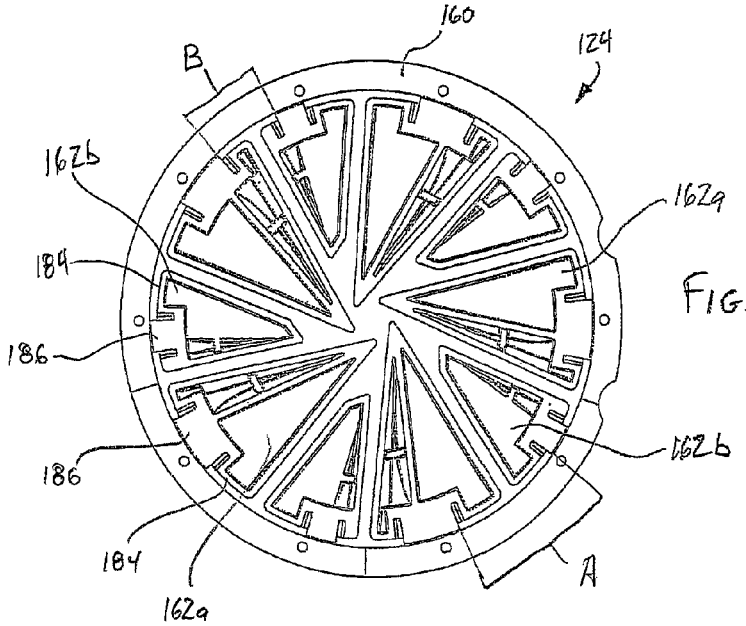
FIG. 7B is a bottom plan view of the embodiment of FIG. 7A.
Figure 8A:
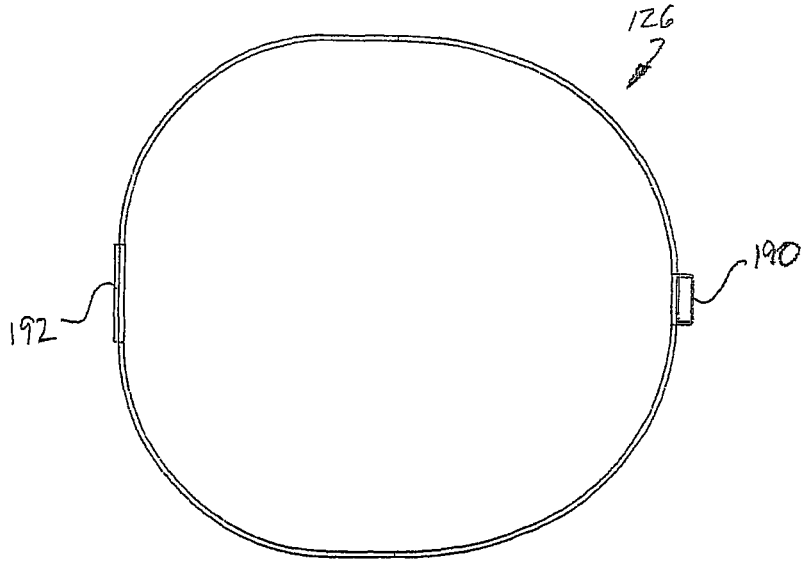
FIG. 8A is a top plan view of the embodiment of a cap as shown in FIG. 3.
Figure 8B:
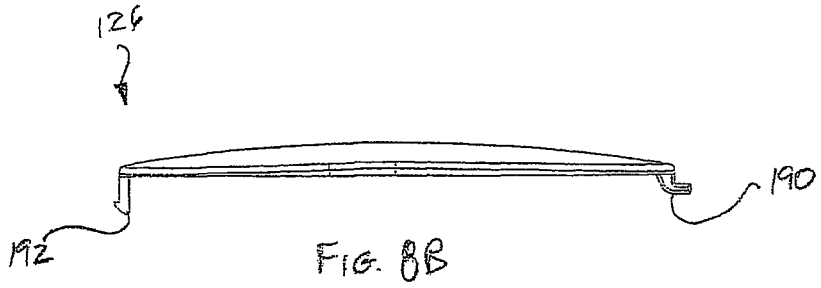
FIG. 8B is a side elevational view of the embodiment of FIG. 7A.
Figure 9:
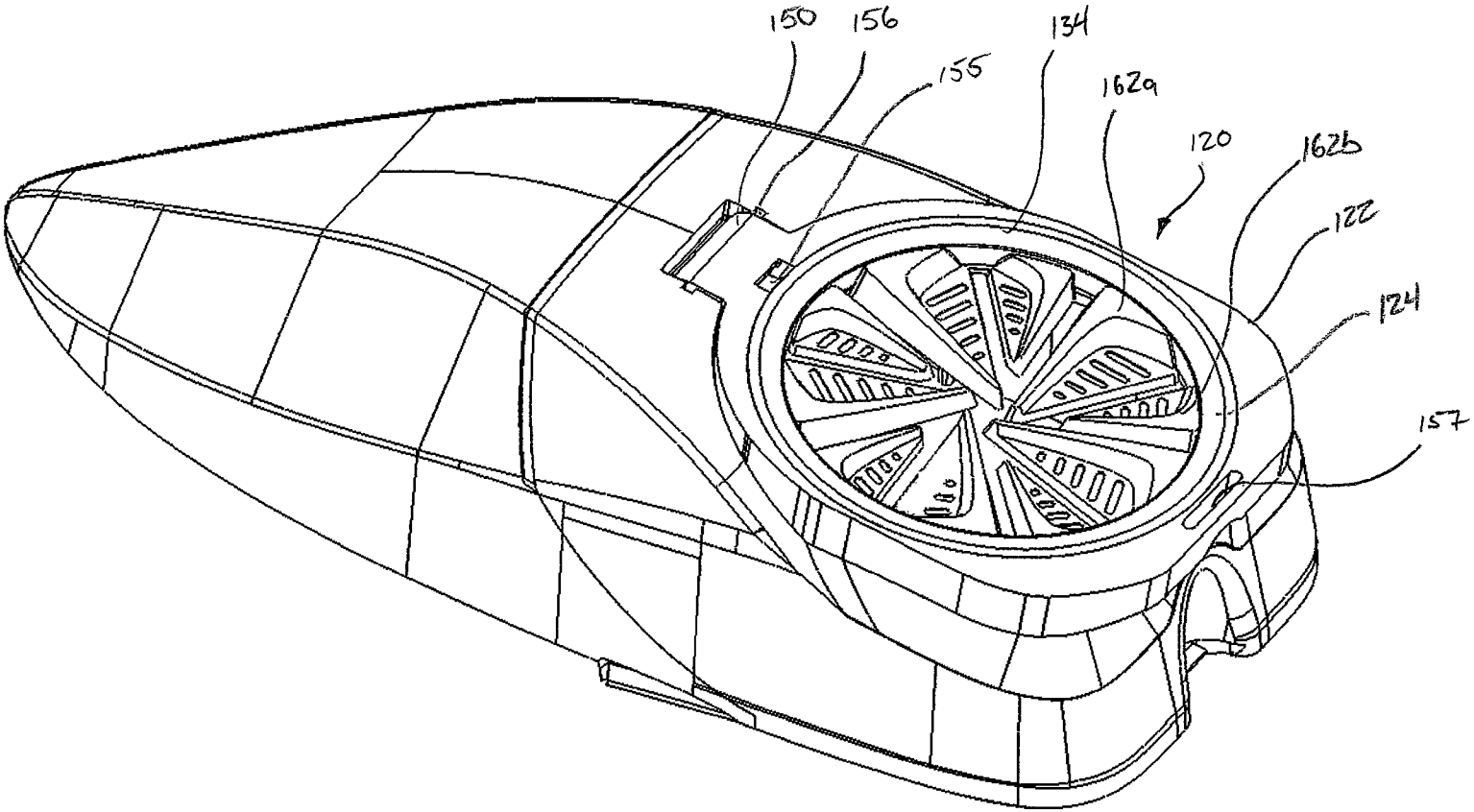
FIG. 9 is a perspective view of the embodiment as shown in FIG. 5 along with a portion of a paintball loader.
Figure 10:
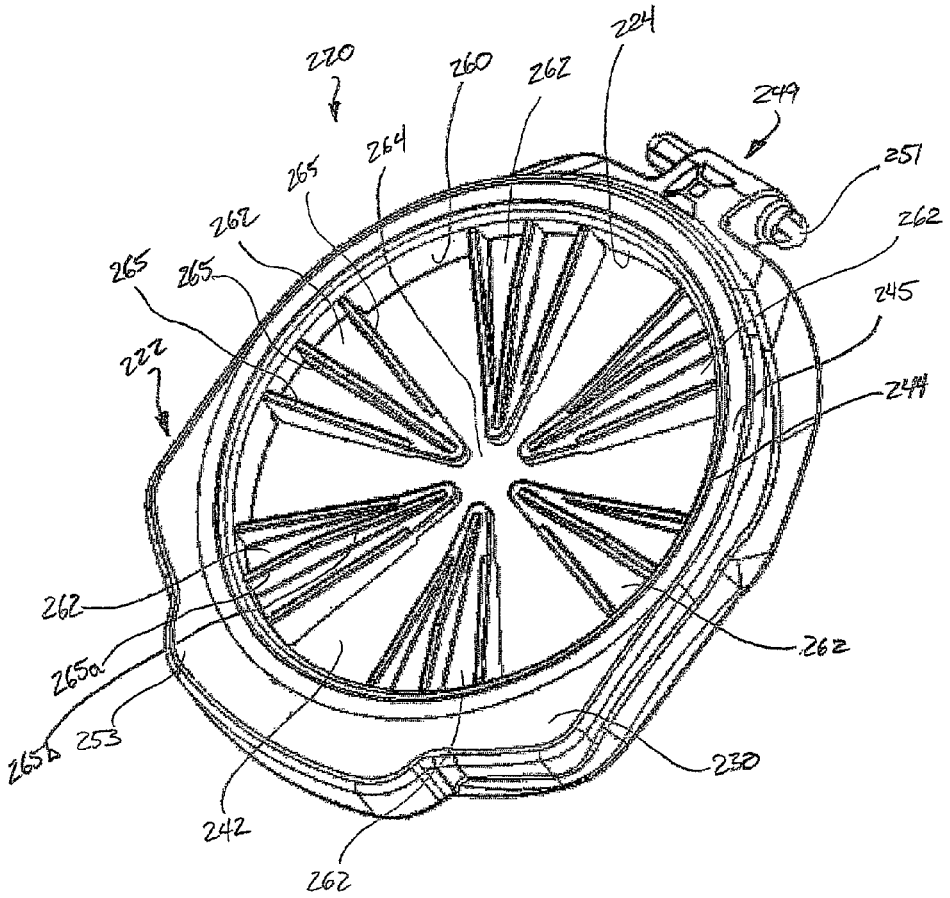
FIG. 10 is a perspective view of an embodiment of a feedgate for a paintball loader.
Figure 11:
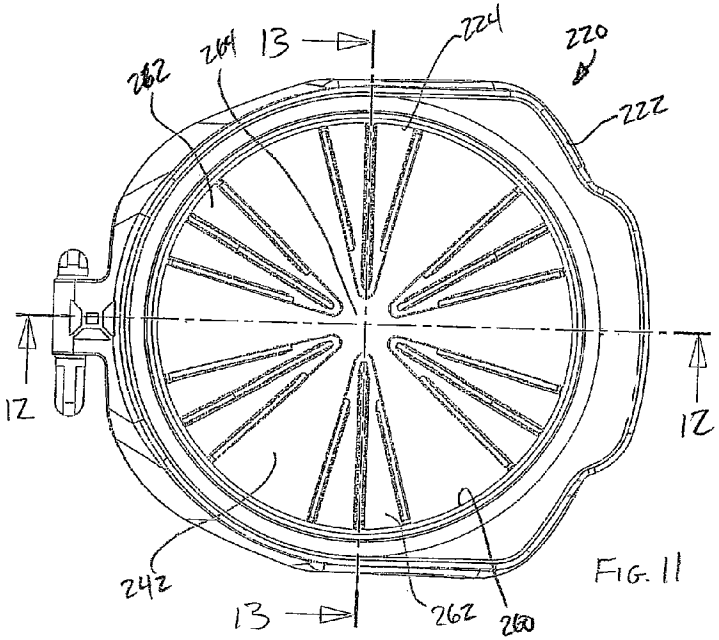
FIG. 11 is a top plan view of the embodiment as shown in FIG. 10.

The embodiment in FIGS. 7A-7B shows wider portion 184 of each vane 162 joined to base 160 via a bridge or bend portion 186 that is smaller in thickness in particular embodiments (and therefore more apt to bend) than the wider portion of vane 162 and/or base 160. As seen in the example of FIGS. 7A and 7B, the bridge portion 186 is smaller in length than the wider portion of vane 162 and is offset or non-centrally aligned with respect to the wider portion of vane 162. Further, in that example it is noted that bridge portions 186 are offset toward side 180 of respective vanes 162, so that bridge portions 186 are generally closer to side 180 than to side 178. That offset alignment allows vanes 162 to twist or rotate more easily in or toward the area of larger space between the bridge portions, in the illustrated embodiment the area of shelves 172 of adjacent vanes 162. The thicker ridge portion on or along side 180 of respective vanes 162 is in an area of smaller space between bridge portions 186 of adjacent vanes 162, making bending or twisting of vanes in that area more difficult. Such an arrangement can resist loss of paintballs through device 120, and allows paintballs to tend to flow from the taller or thicker ridge portions of side 180 of vanes 162 to the lower shelf areas 172, with their greater bend or twist capability, so that paintballs can pass through and into the loader more easily.

Insert 124 is fitted into base 134 of frame 122 so that at least a portion of base 160 of insert 124 sits on ledge 134*c*. Retaining ring 132 is inserted between the inner wall of base 134 and the rear-most parts of vanes 162 of insert 124. Ring 132 is pressed down over base 160 of insert 124 until bosses or snap tabs 137 of ring 132 snap over or otherwise engage lip 136 of base portion 134, so that ring 132 is firmly held with base portion 134, with base 160 of insert 124 gripped or pressed between them. The combination of ring 132 and base 134 obviates the need for adhesives, rivets or similar permanent fixation of insert 124, although it will be seen that adhesives or other additional fixation could be used if desired. However, ring 132 and base 134 permit non-destructive disassembly to allow replacement of insert 124 as may be desired.

The illustrated embodiment of cap or cover 126 is substantially flat or slightly domed, and is shaped substantially identically to base portion 134 of frame 122. A hinge boss 190 is provided on a front edge of cap 126, and has a general L- or J-shape and is sized and configured to slide into front slot 155 of base portion 134 of frame 122. With hinge boss 190 in slot 157, cap 126 can pivot substantially around a portion of hinge boss 190, allowing cap 126 to be lifted from atop or lowered onto frame 122. A snap boss 192 is provided on a rear edge of cap 126, and is substantially planar in the main with an end tab 194. Snap boss 192 is sized and configured to slide into rear slot 157 of base portion 134 of frame 122, engaging a portion of slot 157 or base portion 134 so as to hold cap 126 down over device 120. Bosses 190 and 192 engage the strong, rigid base 134 of frame 122, without having the flexible material of insert 124 in the way, and without risking disengagement of retaining ring 132 when cap 126 is used. Feedgate device 120, when cap 126 is provided, allows the user to cover the feedgate and loader opening, or change quickly between an open loader opening (e.g. with a feedgate) and a covered loader opening.

Embodiments of a feedgate device 220 similar in many respects to devices 20 and 120 is shown in FIGS. 10-19. Features in device 220 that are identical or similar to features of devices 20 and/or 120 are indicated by using the same base number used above, with the prefix 2.

This embodiment of device 220 includes a frame 222 and a flexible insert 224 fixed together. Frame 222 in the illustrated embodiment features a rounded (e.g. generally circular and/or rounded square) body 230 that substantially surrounds a central open area 242. Body 230 has a generally circular edge 244 (which can have a beveled top entry 245) generally directed toward open area 242. Body 230 includes a series of one or more slots 233 that in the illustrated embodiment are at least slightly arcuate, following the curvature of edge 244. Six such slots 233 are shown in diametrically opposed pairs across open area 242 for stability, but it will be understood that other embodiments may feature different numbers and/or arrangements of slots. Frame 222 further includes in this embodiment an extension 249 having an axle 251 connected to it, for pivotable connection to a paintball loader device. A grip or handle 253 extends from a surface opposite extension 249. Slots 233 in this embodiment are offset from handle 253 and extension 249 in this embodiment. In particular embodiments the lower surface or extremity of frame 222 is substantially planar, and is adjacent to, facing, and/or against a portion of a paintball loader when in use.

Insert 224 is a flexible, generally planar piece or paddle having an outer ring or base 260 and a number of inwardly-facing vanes 262. In the illustrated embodiment, base 260 is a continuous, circular portion forming an edge or border of insert 224 and having an open middle 264 with a center point. From an inside edge or surface of base 260, vanes 262 extend into the open middle 264. A cover flap 264*a* extends from a front portion of base 260 and provides benefits such as a smooth and easy-to-clean top surface, and/or a covering for fastening features or for areas for storage or placement of additional features (e.g. electronics). In particular embodiments, vanes 262 and base 260 are of the same material, and may be monolithic (i.e. part of one single piece).

The illustrated embodiment shows six separate vanes 262 which are substantially identical, with each vane 262 having a wider portion joining to base 260 and narrowing linearly or uniformly toward a blunt or rounded tip (e.g. with converging sides in a substantially triangular or arrowhead shape). The tip of each vane 262 points generally to the center point within open middle 264 and is at a particular distance from the center, so that a circle can be drawn through each tip, and in exemplary embodiments that circle is at least slightly smaller than the diameter of standard paintballs. Further, the width of each vane 262 is preferably such that the size of the gaps between adjacent vanes 262 is smaller than the diameter of standard paintballs. It will be understood that in other embodiments, variations in the vanes 262 may be made. For example, a larger or smaller number of vanes may be used, bearing in mind the general desirability of keeping spaces between vanes smaller than the diameter of paintballs. Similarly, vanes may be made wider or slimmer, or longer or shorter, than indicated in the drawings.

Vanes 262 in this particular embodiment include an upper surface 263 that includes three raised ribs or splines 265, one of which is in the center of vane 262 (i.e. along a bisector of the angle formed by the sides of the vane 262) and the other two of which are along the sides of vane 262. Each rib or spline 265 in this embodiment is substantially planar (e.g. of uniform width), with a maximum height (measured from the surface 263 of vane 262) greater than its width. The central rib 265 has a portion 265*a* adjacent base 260 that is of a constant height, and an inner portion 265*b* in which the height decreases substantially uniformly to the surface 263 of vane 262. The side ribs 265 decrease in height substantially uniformly from their connection with base 260 to surface 263 in this embodiment. Further, in the illustrated example side ribs 265 also extend from an undersurface 267 of vane 262. Undersurface 267 is otherwise substantially flat or planar. Each vane 262 joins to base 260, e.g. on an underside of base 260, and in the illustrated embodiment each vane 262 has a narrowed portion adjacent base 260 that is within or adjacent slot 233 of frame 222 when assembled. The use of one or more such ribs 265 on vanes 262 provide for a desirable bias against bending of vanes 262 outward. The planar underside 267 provides no counterforce against inward bending of vanes 262. The decreasing height of ribs 265 provide barriers to outward bending of vanes 262 due to the larger height adjacent base 260, and the smaller height of ribs 265 toward the tip of vanes 262 reduce resistance to inward bending.

Figure 12:
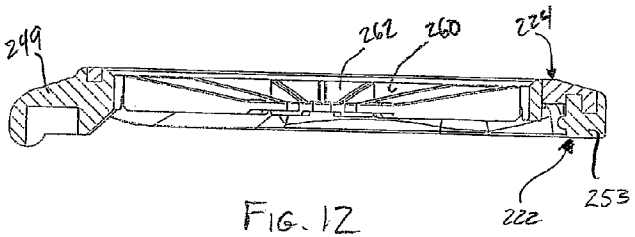
FIG. 12 is a cross-sectional view of the embodiment as shown in FIG. 11, taken along the lines 12-12 in FIG. 11 and viewed in the direction of the arrows.
Figure 13:
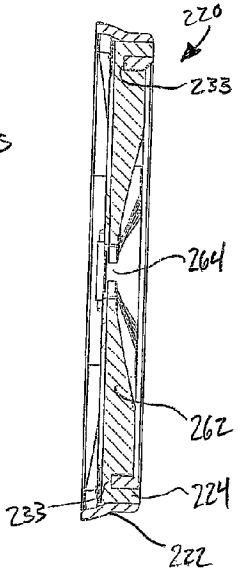
FIG. 13 is a cross-sectional view of the embodiment as shown in FIG. 11, taken along the lines 13-13 in FIG. 11 and viewed in the direction of the arrows.
Figure 14:
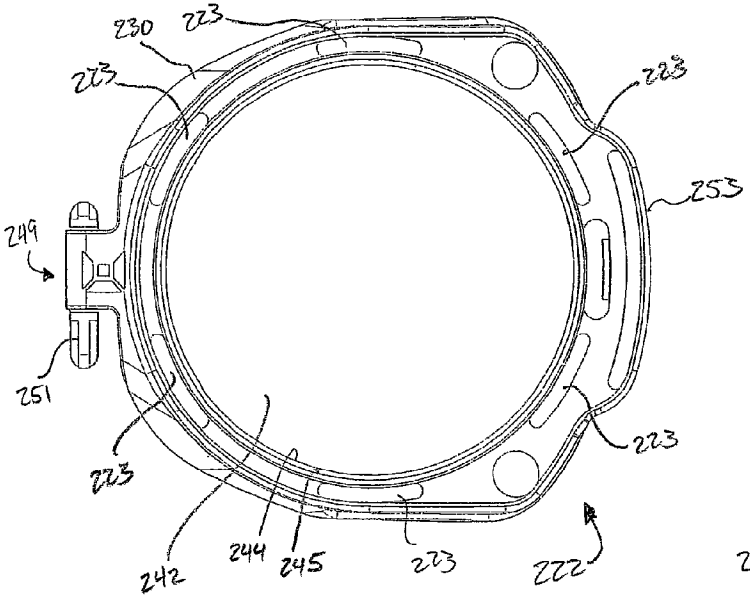
FIG. 14 is a top plan view of a portion of the embodiment as shown in FIG. 11.
Figure 17:
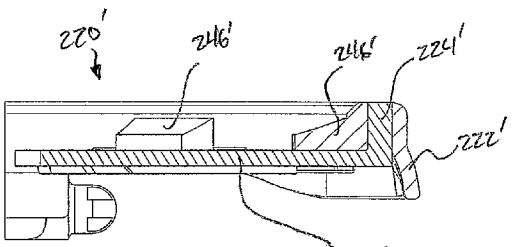
FIG. 17 is a cross-sectional view of the embodiment as shown in FIG. 16, taken along the lines 17-17 in FIG. 16 and viewed in the direction of the arrows.
Figure 16:
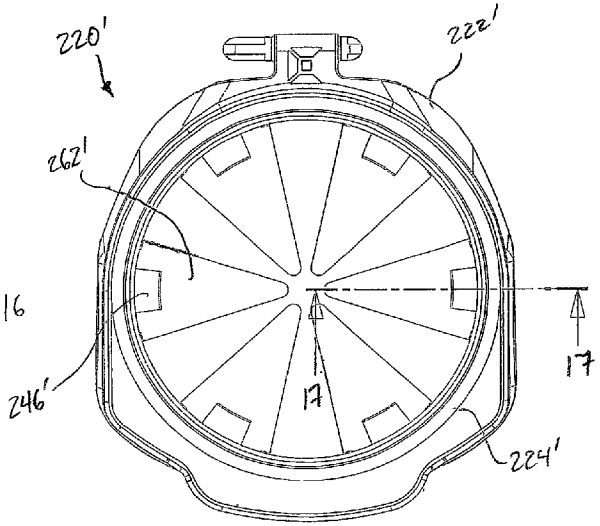
FIG. 16 is a top plan view of an embodiment similar to that of FIG. 11.
Figure 19:
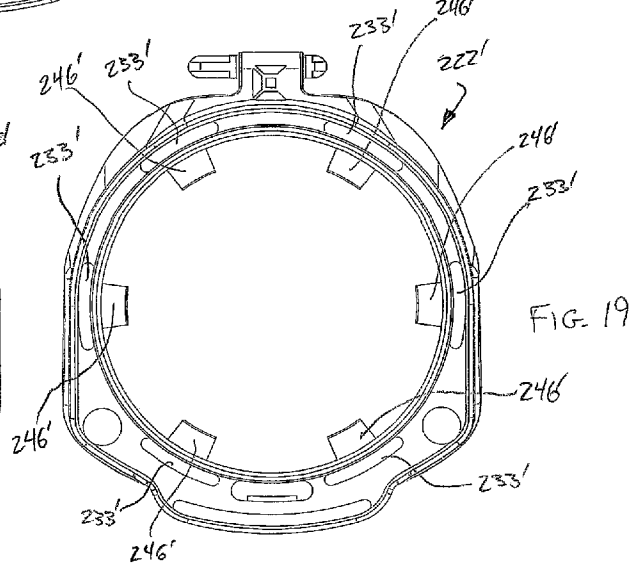
FIG. 19 is a top plan view of a portion of the embodiment shown in FIG. 16.
Figure 18:
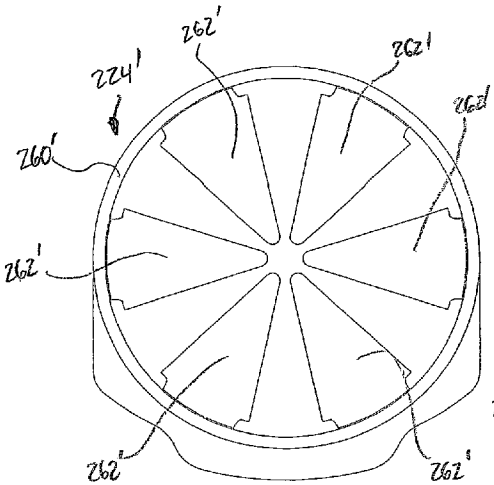
FIG. 18 is a top plan view of a portion of the embodiment shown in FIG. 16.

Insert 224 is fitted into frame 222 so that base 260 of insert 224 is firmly fixed within frame 222. Vanes 262 of insert 224 are inserted and pulled through respective slots 233 in frame 222, with ribs 265 deflecting and/or compressing during the pulling-through. In this embodiment, the maximum width of vanes 262 are approximately the same as the width of slots 233. With vanes 262 pulled through the slots (e.g. so that the narrowed portion at the rear of vanes 262 face the sides or ends of slots 233), vanes 262 extend toward the middle of device 220 and ribs 265 return to and unstressed condition. Base 260 prevents further pulling of vanes 262 through slots 233, and when assembled engages or lies adjacent to a frame 222. As indicated in FIG. 12, insert 224 and frame 222 meet with a snap-in fit with generally U-shaped portions interengaging.

Similar embodiments of an insert 224' with a frame 222' is indicated in FIGS. 16-19, with features similar or identical to those noted above having the same number with a prime. Insert 224' includes vanes 262' that have a maximum width (adjoining base 260') that is larger than the slots 233' provided in frame 222'. Vanes 262' thus compress or fold when inserted through slots 233', and expand back to their unstressed shape when insertion is complete. Frame 222' includes tabs 246' that extend over vanes 262', restricting their upward flexibility. As may be seen in FIG. 17, an L-shaped profile or meeting between frame 222' and insert 224' help hold insert 224' in place in frame 222', with base 260' being substantially perpendicular to vanes 262'. A device 220' using insert 224' and/or frame 222' is assembled and operates similarly to embodiments of device 220.

Use of device 220 is very similar to the use of the embodiments noted above. Device 220 is attached to a loader (not shown) by fitting device 220 over or into the supply hole of the loader, so that insert 224 and open area 242 of frame 222 are over the supply hole. Device 220 is then fixed to the loader in that position. With device 220 so positioned and fixed to the loader, the user can load paintballs easily through device 220 and into the loader. The user may take a pod or other container of paintballs and orient or locate the container so that it is over open area 242 in frame 222 and vanes 262 of insert 224. Paintballs exiting the container hit vanes 262, which as noted above easily bend inward, and allow paintballs through and into the main chamber of the loader. When loading is complete, vanes 262 elastically return to their initial position, so that gaps between vanes 262 are smaller than the diameter of the paintballs within the loader. As the user runs with, fires and otherwise plays paintball with his or her marker and loader, the paintballs within the loader may be shaken or moved toward the loader's supply opening. Device 220 limits or inhibits exit of paintballs, as outward bending of vanes 262 when paintballs strike them from inside the loader is limited or inhibited by the placement and structure of ribs 265.

It will be understood that features or structures identified with a particular embodiment may be used with other embodiments as well. For example, a lip for better location or orientation of filling containers with respect to a feedgate may be used with any of the embodiments discussed above, or other embodiments. As other examples, a snap-in insert, inserts with various orientations or features in its vanes, and/or a cap system may be used with any of the embodiments discussed above, or other embodiments.

While the subject matter herein has been illustrated and described in detail in the exemplary drawings and foregoing description, the same is to be considered as illustrative and not restrictive in character, it being understood that only the preferred embodiment(s) have been shown and described and that all changes and modifications that come within the spirit of the disclosure are desired to be protected. It will be understood that structures, methods or other features described particularly with one embodiment can be similarly used or incorporated in or with respect to other embodiments.

What is claimed is:

1. A feedgate for a paintball loader, comprising:

a frame defining a central open area;

an insert fixed with respect to the frame, the insert having a base portion defining a middle open area with a center point and a plurality of vanes extending from the base portion into the middle open area, wherein at least one of the vanes includes a tip pointing in a direction offset from the center point of the middle open area.

2. The feedgate of claim 1, wherein the plurality of vanes includes an even number of vanes comprising an equal number of first vanes and second vanes, the first vanes being larger than the second vanes.

3. The feedgate of claim 2, wherein the first vanes have a wide portion attached to the base portion of the insert and narrow to a tip, and the distance from the base portion of the insert to the tip is approximately the distance from the base portion to the center point.

4. The feedgate of claim 1, wherein a first vane and a second vane of the plurality of vanes are adjacent each other, the first vane joined to the base via a first bridge portion that is offset with respect to the center of the first vane, the second vane joined to the base via a second bridge portion that is offset with respect to the center of the second vane.

5. The feedgate of claim 4, wherein the relative offsets of the first bridge portion with respect to the first vane and of the second bridge portion with respect to the second vane is one of toward each other or away from each other.

6. The feedgate of claim 1, wherein at least one pair of vanes include a flat shelf portion along one side and a raised ridge portion along the other side and adjacent the base portion of the insert.

7. The feedgate of claim 6, wherein the at least one pair of vanes are adjacent each other, and the respective vanes' flat shelf portions face each other.

8. The feedgate of claim 6, wherein the at least one pair of vanes are adjacent each other, and the respective vanes' sides having a raised ridge portion face each other.

9. The feedgate of claim 8, wherein a first of the pair of vanes is joined to the base via a first bridge portion that is offset with respect to the center of the first vane, a second of the pair of vanes is joined to the base via a second bridge portion that is offset with respect to the center of the second vane, and wherein the relative offsets of the first bridge portion with respect to the first vane and of the second bridge portion with respect to the second vane is toward each other.

10. The feedgate of claim 6, wherein between the flat shelf portion and the raised ridge portion is a curved wall.

11. The feedgate of claim 1, wherein the frame includes a base portion and a retaining ring that fits within the base portion of the frame, wherein the insert is fixed to the frame with at least part of the base portion of the insert between the base portion of the frame and the retaining ring.

12. The feedgate of claim 11, wherein the base portion of the frame includes an inner wall having a ledge, and the retaining ring includes an external wall with a tab, whereby the retaining ring is fixed with the base portion of the frame when the tab is adjacent or engages the ledge.

13. The feedgate of claim 1, wherein the frame includes a lower surface from which a tab extends for assembly with a paintball loader.

14. The feedgate of claim 1, wherein the frame includes an upper surface with a first front slot and a second rear slot, and further comprising a cap having a hinge boss inserted into the first front slot and a snap boss for insertion into the second rear slot, wherein the cap is pivotable substantially around the hinge boss between an open position in which the cap does not impede access to the insert and a closed position in which the cap is over the insert.

* * * * *